United States Patent [19]

Hallenbeck et al.

[11] 4,282,739

[45] Aug. 11, 1981

[54] GEARED POWER AMPLIFICATION UNIT FOR PRESSES

[75] Inventors: Norman P. Hallenbeck, Hebron; Stephen F. Willard, Andover, both of Conn.

[73] Assignee: N. P. Halenbeck Company, Vernon, Conn.

[21] Appl. No.: 64,891

[22] Filed: Aug. 8, 1979

[51] Int. Cl.[3] ..... B21J 9/12

[52] U.S. Cl. ..... 72/449; 72/453.03; 74/422; 100/270

[58] Field of Search ..... 72/449, 429, 445, 453.02, 72/453.03; 100/266, 279, 270; 74/110, 422

[56] References Cited

U.S. PATENT DOCUMENTS

| | | | |
|---|---|---|---|
| 2,283,746 | 5/1942 | Lohs | 74/422 |
| 2,525,805 | 10/1950 | Kirkpatrick | 74/422 |
| 2,708,372 | 5/1955 | Korsmo | 74/110 |
| 2,772,574 | 12/1956 | Thomas | 74/110 |
| 2,884,573 | 4/1959 | Watson | 74/110 |
| 3,405,032 | 10/1968 | Barrus | 74/110 |
| 3,524,436 | 8/1970 | Braun | 74/110 |
| 3,528,366 | 9/1970 | Neuenburg | 100/270 |
| 3,665,771 | 5/1972 | Blatt | 91/188 |
| 3,799,031 | 3/1974 | Hallenbeck | 92/129 |
| 4,022,052 | 5/1977 | Hallenbeck | 100/266 |

FOREIGN PATENT DOCUMENTS

| | | | |
|---|---|---|---|
| 402822 | 9/1924 | Fed. Rep. of Germany | 100/278 |
| 407574 | 12/1924 | Fed. Rep. of Germany | 100/278 |

*Primary Examiner*—Lowell A. Larson
*Assistant Examiner*—Gene P. Crosby

[57] ABSTRACT

The ram of a hot-stamping press is driven by means of a movable rack that can be allowed to change position with respect to the ram. The rack engages gears on the end of the ram opposite its head, but during the initial portion of its stroke an air cylinder interior to the ram prevents relative motion between the movable rack and the ram. As a consequence, the ram moves at the same velocity as that of the rack during the initial portion of the stroke. Stationary racks are also provided, and additional gears mechanically linked to the gears engaged by the movable rack begin to engage the stationary rack toward the end of the stroke. This requires relative motion of the movable rack relative to the ram despite the force applied by the air cylinder inside the ram, and the velocity of the ram is thereby reduced to a fraction of that of the rack. This results in force multiplication toward the end of the ram stroke.

12 Claims, 4 Drawing Figures

GEARED POWER AMPLIFICATION UNIT FOR PRESSES

BACKGROUND OF THE INVENTION

The present invention is applicable to many kinds of presses, the preferred embodiment having been designed for use in a hot-stamping machine.

Stamping presses frequently include a ram operatively connected to an in-line pneumatic or hydraulic cylinder. The ram applies pressure to a workpiece when the cylinder is operated to apply force to the ram. The cylinder is used both to apply the operating pressure for the stamping function and to move the ram in and out of engagement with the workpiece to allow the workpiece to be placed in position or removed. Obviously, the amount of force necessary during the pressure portion of the operation is greater than that required merely to move the ram into and out of engagement with the workpiece. Accordingly, machines have been designed in the past to provide the requisite stamping force only at the end of travel of the ram.

An example of a machine in which the stamping force is only available at the end of the cycle is illustrated in U.S. Pat. No. 3,799,031 to Hallenbeck et al. A first air cylinder sized to provide the stroke and force appropriate for merely moving the ram into and out of engagement is employed during the first part of the stroke, while a second air cylinder is brought to bear at the bottom of the stroke, where the stamping pressure is required. This has proved to be an advantageous arrangement for hot stamping, but an alternate arrangement was devised by the same inventors in order to obtain the greater smoothness and repeatability that is desired in some applications. The alternate arrangement is illustrated in U.S. Pat. No. 4,022,052 to Hallenbeck et al. In this arrangement, the lower expense of longer-stroke air cylinders is obtained even though the air cylinder is used for a short-stroke high-pressure ram operation. This is accomplished by connecting the air cylinder to the ram by means of a pulley arrangement, which affords a mechanical advantage that permits a short-stroke, high-force ram to be operated by a longer stroke, lower-force air cylinder. Since a single air cylinder is used for driving the ram, a smooth, repeatable ram stroke is obtained.

It is an object of the present invention to obtain the advantages of a two-stage machine illustrated in the '031 patent while obtaining the smooth operation and mechanical advantage illustrated in the '052 patent.

SUMMARY OF THE INVENTION

The foregoing and related objects are achieved in a stamping press with an augmented power stroke that includes a support having a guide portion and a ram slidably seated in the guide portion of the support for movement between first and second positions. The ram has a head portion at one end adapted for mounting tool means. The head portion is spaced from a workpiece when the ram is in the first position and spaced adjacent the workpiece when the ram is in the second position. An elongated movable rack means provides a rack surface extending generally parallel to the axis of movement of the ram, and drive means are operatively connected to the movable rack means for reciprocation of the movable rack means in the direction of movement of the ram. Elongated stationary rack means fixedly mounted on the support provide a rack surface extending generally parallel to the movable rack surface. Gear means are disposed on the end of the ram opposite the head portion and mesh with the rack surface of the movable rack means. The gear means are spaced from the stationary rack surface in the first position of the ram. The gear means mesh with the stationary rack surface, when the rack means move to a predetermined engagement distance from the second position, to produce movement of the stationary rack means relative to the ram in the direction opposite the movement of the movable rack means and thereby effect movement of the ram between the second position and the predetermined engagement distance from the second position in the same direction as that of the movable rack means. Finally, the press includes means for maintaining the ram substantially in a predetermined position relative to the movable rack means while the stationary rack surface is spaced from the gear means but permitting relative movement while the stationary rack surface meshes with the gear means. The ram thereby moves with substantially the same velocity as that of the movable rack means while the stationary rack surface is spaced from the gear means, but it moves with a velocity whose ratio to that of the movable rack means is determined by the gear means when the stationary rack means meshes with the gear means.

Preferably, the gear means include at least first and second gears. The first gear meshes with the stationary rack surface when the ram is less than the predetermined engagement distance from the second position, but it is spaced from the stationary rack means when the ram is more than the predetermined engagement distance from the second position. The second gear meshes with the movable rack and is mechanically linked to the first gear for relative movement of the movable and stationary rack means in opposite directions relative to the ram when the first gear of the gear means meshes with the stationary rack means. The first gear would typically have a radius smaller than that of the second gear.

Conveniently, the gear means could have a gear shaft mounted for rotation about its axis on the end of the ram opposite the head portion. The gear shaft would be disposed between the stationary and movable rack means, the first and second gears being coaxially mounted on the gear shaft for rotation with it.

In the preferred embodiment, the movable rack means provides a second rack surface parallel to the first-mentioned movable rack surface and extending parallel it on the side of the movable rack means opposite the first movable rack surface. The preferred embodiment further includes second elongated stationary rack means fixedly mounted to the support and providing a stationary rack surface extending generally parallel to the movable rack surfaces and spaced from the second movable rack surface on the side of the movable rack means opposite the first-mentioned stationary rack means. Second gear means on the end of the ram opposite the head portion mesh with the second movable rack surface, are spaced from the second stationary rack surface in the first position of the ram, and, when the ram moves to a predetermined engagement distance from the second position, mesh with the second stationary rack means to produce movement of the stationary rack means relative to the ram in the direction opposite the movement of the movable rack means. The second gear means includes at least first and second gears, its first gear meshing with the second stationary rack surface when the ram is less than the predetermined engagement distance from the second position. The first gear of the second gear means is spaced from the second stationary rack surface when the ram is more than the predetermined engagement distance from the second position. The second gear of the second gear means meshes with the second movable rack surface and is mechanically linked to the first gear of the second gear means for relative movement of the movable rack means and the second stationary rack means in opposite directions relative to the ram when the first gear of the second gear means meshes with the second stationary rack surface. Like the first gear means, the second gear means can include a gear shaft mounted for rotation about its axis on the end of the ram, the gear shaft of the second gear means being disposed between the second stationary rack means and the movable rack means, the first and second gears of the second gear means being coaxially mounted on the gear shaft of the second gear means for rotation with it.

Each of the first and second gear means in the preferred embodiment includes a third gear mounted coaxially with its first and second gears on its gear shaft for rotation with the gear shaft. The third gear of each gear means has the same diameter as that of the first gear of the same gear means and is mounted on the side of the second gear of that gear means opposite its first gear. In this arrangement, third and fourth stationary rack means are fixedly mounted on the support, each of them providing a rack surface spaced from and extending generally parallel to the movable rack surfaces. The third and fourth stationary rack means are spaced from the third gears of the first and second gear means, respectively, when the ram is in its first position, and the third gears of the first and second gear means mesh with the third and fourth stationary rack surfaces, respectively, when the ram moves to the predetermined engagement distance from the second position.

The drive means typically include a main fluid-operated piston-and-cylinder unit that has a main cylinder fixedly mounted on the support and a main piston slidably received in the main cylinder for movement substantially parallel to the axis of movement of the ram between relatively extended and retracted positions. The main piston is operatively connected to the movable rack means to drive it, and the main piston-and-cylinder unit is operable by application of pressurized fluid to apply force to the movable rack means to drive it in the direction of the head portion of the ram.

The drive means can also include spring means biasing the ram toward the first position to return it to the first position upon removal of the force of the main piston-and-cylinder unit from the movable rack means.

The means for maintaining the ram substantially in a predetermined position relative to the movable rack means while the stationary rack means is spaced from the gear means can include a fluid-operated piston-and-cylinder unit that has a piston slidably mounted in it for movement substantially parallel to the axis of movement of the ram between extended and retracted positions, one of the piston and cylinder being attached to the ram, the other being attached to the movable rack means. The piston-and-cylinder unit is operable by application of pressurized fluid to it to bias the piston toward the extended position and thereby maintain the movable rack means and the ram in their predetermined relative positions when the gear means is spaced from the stationary rack surface.

BRIEF DESCRIPTION OF THE DRAWINGS

These and further features and advantages of the present invention are described in connection with the attached drawings, in which.

DETAILED DESCRIPTION OF THE PREFERRED EMBODIMENT

Figure 1:
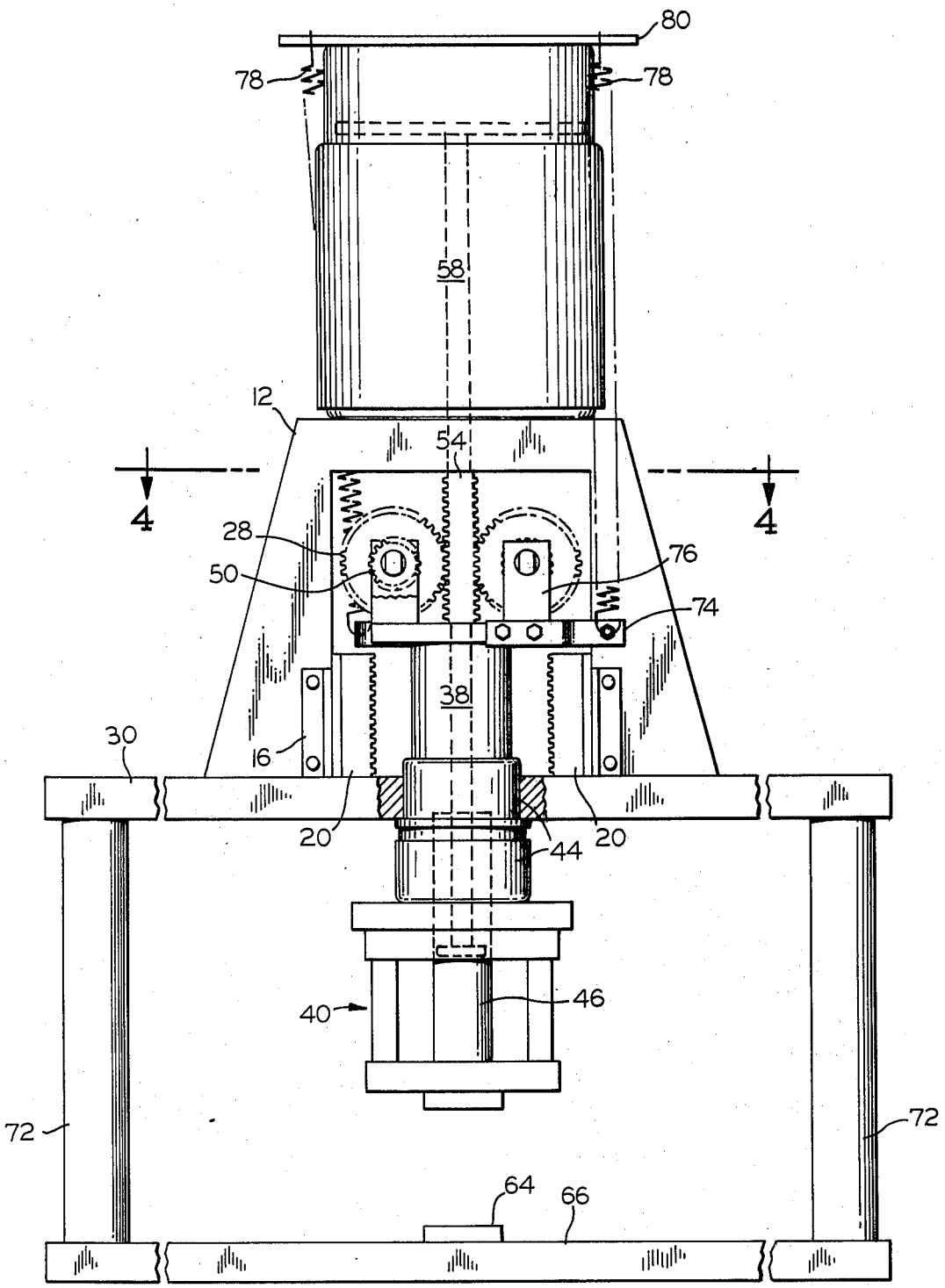
FIG. 1 is a front elevation, partly broken away, of the preferred embodiment of the present invention.

FIG. 1 illustrates the preferred embodiment of the present invention, in which a ram having a ram shaft 38 and a head portion 40 is reciprocated relative to a support by a movable rack 54 driven by an air cylinder 58 that engages gears such as 28 attached to the ram. Head portion 40 is shown greatly simplified for present purposes because a wide variety of tooling could be used at the end of the ram. The tooling might typically include means for hot stamping such as the type illustrated in FIG. 1 of U.S. Pat. No. 3,799,031 to Hellenbeck and Willard, which is hereby incorporated by reference. The apparatus may also include some type of die means 64 in which the workpiece is received during the stamping operation.

The support structure includes a horizontal base plate 66 and a main support plate 30 supported above the main base plate 66 by support posts 72. The support structure also includes a main-cylinder mounting frame 12 mounted on main support plate 30. Frame 12 provides a mounting surface for a main air cylinder 58.

Main support plate 30 has a central opening in which a bushing 44 is mounted to act as a guide portion of the support. Ram shaft 38 is slidably seated in bushing 44 for reciprocation between a first position, shown in FIG. 1, and a second position, shown in FIG. 3. The end of the ram opposite head 40 has a generally horizontal gear-assembly base plate 34 from which gear mounting plates 76 extend upwardly. Gear shafts for large and small gears 28 and 50 are journaled in gear mounting plates 76. In a manner explained in more detail below, reciprocation of the rack is effected by means of a movable rack 54 that is actuated by main air cylinder 58 and engages large gears 28. In addition to movable rack 54, stationary racks 20 are mounted on frame 12 for engagement by small gears 50 during part of their travel.

Also illustrated in FIG. 1 are springs 78 that apply an upward force to the ram. Lower spring mounting bars 74 are attached to the gear-assembly base plate 34, and the springs 78 are stretched between lower spring mounting bars 74 and an upper spring mounting bar 80 attached to the top of main air cylinder 58.

It will be apparent from the more detailed description that follows that the assembly of FIG. 1 can be broken down according to relative motion into three component parts. The first is the stationary part, which includes the support structure generally, the stationary racks, and the main air cylinder 58. The second part includes ram shaft 38 and ram head 40 along with gear mounting plate 34 and gears 28 and 50, all of which move with the ram. The third component would include movable rack 54 and the piston in main air cylinder 58 by which rack 54 is reciprocated. Although, as will be seen below, the ram moves with the same velocity as that of movable rack 54 during one part of its travel, rack 54 moves relative to the ram during another part of its travel.

Figure 2:
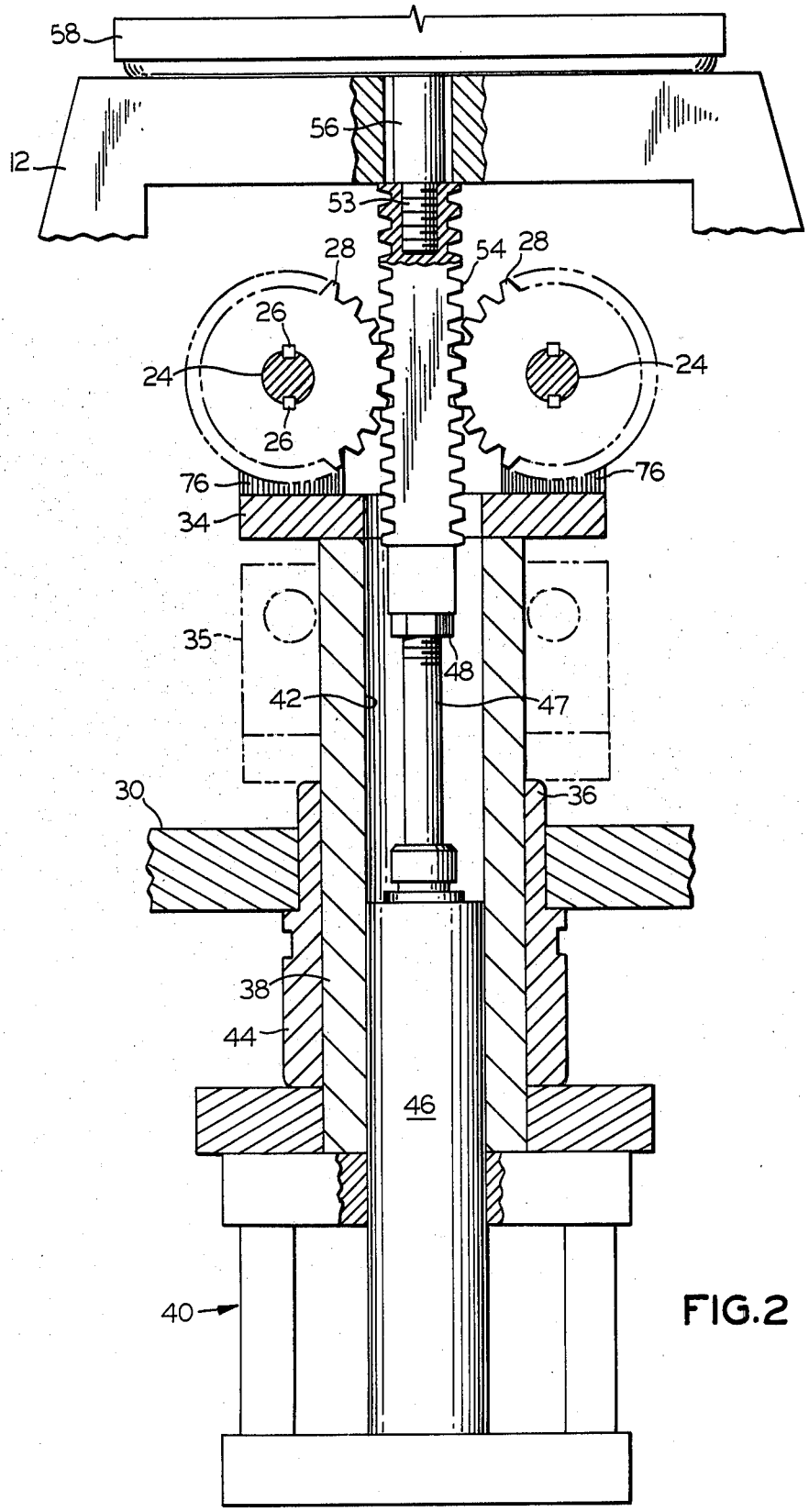
FIG. 2 is a detailed view of a portion of FIG. 1 with additional parts broken away for further detail.

FIG. 2 illustrates in more detail the connection between the ram and movable rack 54. A piston rod 56 connected to the piston in main air cylinder 58 extends through a suitable opening in frame 12 so that it can be reciprocated relative to frame 12. On the lower end of piston rod 56 is a threaded portion 53 onto which movable rack 54 is threaded. Rack 54 extends along the axis of motion of the ram into a central bore 42 provided in ram shaft 38. Movable rack 54 is attached at its lower end by a nut 48 to the piston rod 47 of a second air-actuated piston-and-cylinder assembly. This assembly includes a pneumatic cylinder 46, which is fixedly mounted in bore 42 of ram shaft 38. Air cylinder 46 can be actuated by application of compressed air to urge its interior piston in either direction. Since the interior piston is connected by piston rod 47 to movable rack 54, rack 54 can be urged in either direction relative to the ram by application of compressed air to pneumatic cylinder 46.

Air cylinder 46 is shown in FIG. 2 in its relatively extended position, in which its purpose is to maintain the relative positions of the movable rack 54 and the ram as the main air cylinder 54 forces movable ram 54 downwardly. The force applied by air cylinder 46 is low compared to that which can be applied by main air cylinder 58, and it can therefore be overcome by the force from main air cylinder 58 at the point at which small gears 50 engage the stationary racks 20 (FIG. 1). This engagement occurs somewhere between the position shown in solid in FIG. 2 and the position indicated by the phantom 35 of gear mounting plate 76 and gear-assembly support plate 34.

Phantom 35 indicates that downward travel of the ram is limited by the interference of a shoulder portion 36 of bushing 44 with gear-assembly support plate 34.

Figure 3:
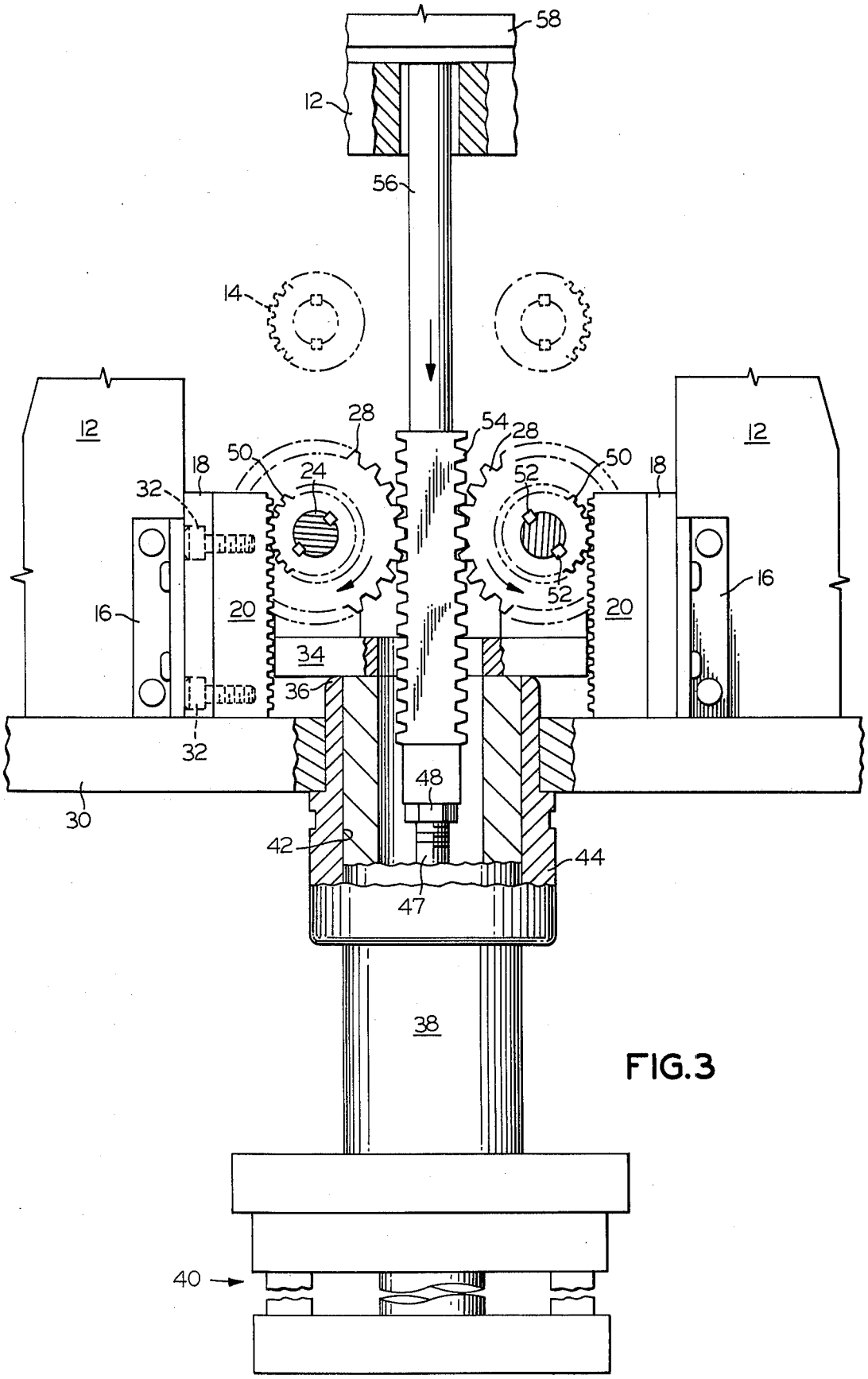
FIG. 3 is a detailed view of a portion of FIG. 1, also with parts broken away, showing the ram in its downward position.
Figure 4:
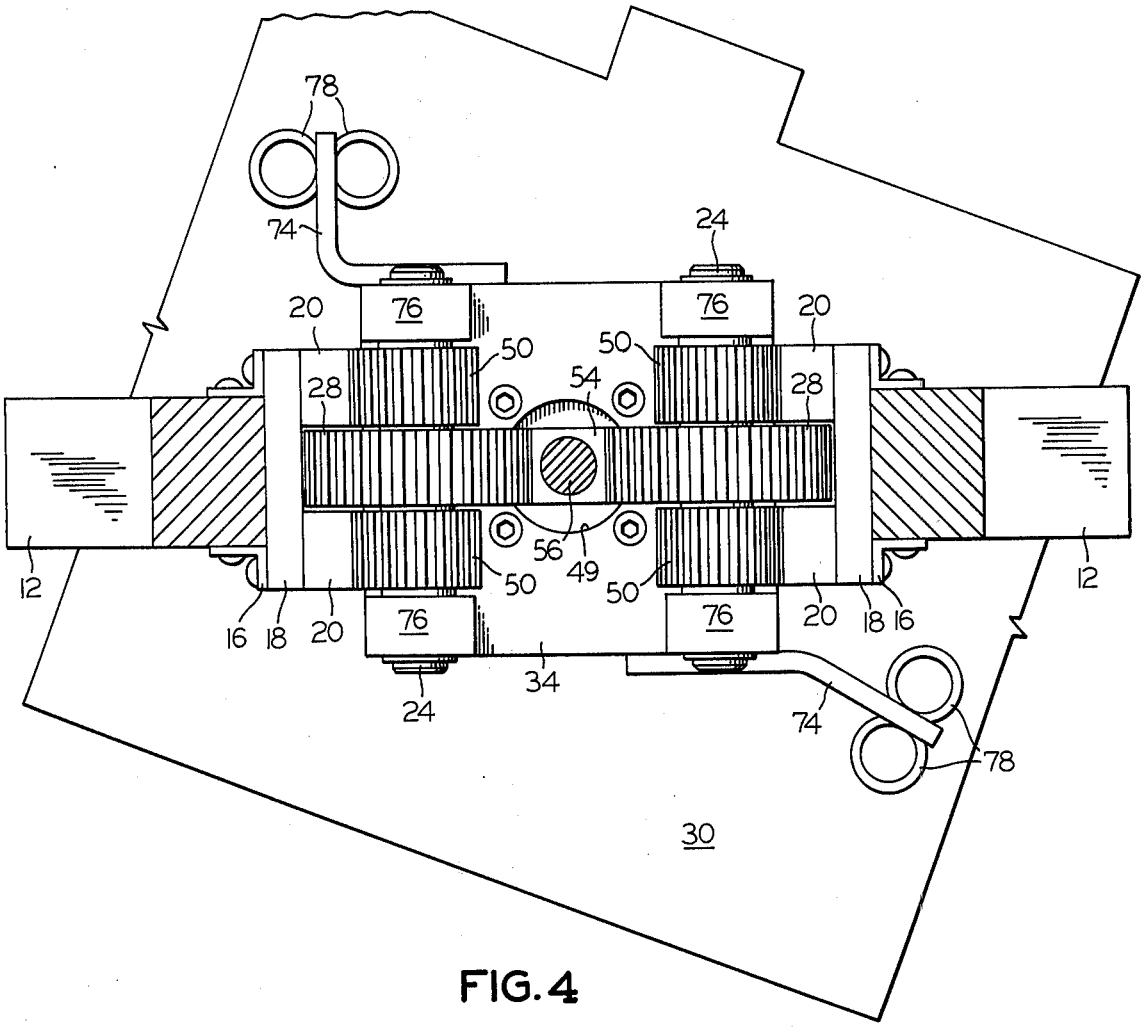
FIG. 4 is a cross-sectional view taken at line 4—4 of FIG. 1.

The position shown in phantom in FIG. 2 is illustrated in more detail in FIG. 3. FIG. 3 shows stationary racks 20 attached by appropriate bolts 32 to rack mounting plates 18, to which in turn are secured to frame 12 by appropriate brackets 16. As simultaneous reference to FIGS. 3 and 4 reveals, two stationary racks 20 are provided on both the left and right sides in FIG. 3, both stationary racks on either side being axially spaced to either side of movable rack 54. As FIG. 4 shows, this permits engagement of small gears 50 by stationary racks 20 while large gear 52 is engaged by movable rack 54. Each large gear 28 is mounted on a gear shaft 24 with two of the small gears 50, and the large and small gears are fixed in rotational position relative to gear shaft 24 by keys 26 and 52, respectively. The large and small gears on each side are thereby mechanically linked so that they rotate together. Consequently, during that part of the travel of the ram in which small gears 50 engage stationary racks 20, large gear 50 is required to rotate as the ram moves downwardly. It is possible while the gears are spaced from stationary rack 20 as shown by phantom 14 in FIG. 3 for large gears 28 not to rotate as stationary rack 54 is propelled downwardly, but rotation is required once small gears 50 engage stationary racks 20.

In operation, the ram begins in the position shown in FIG. 1, in which ram head 40 abuts the lower end of bushing 44. The ram is kept in the upward position by springs 78, which bias the ram upward. Movable rack 54 is also in its upward position because air cylinder 46 is actuated to apply upward force to movable rack 54 and thereby keep it and the main piston rod 56 at the upward limit of their travel.

Once the workpiece is in place, air cylinder 58 is actuated to overcome the spring force and to urge movable rack 54 downward. Because air cylinder 46 is actuated to maintan it in its relatively extended position, the ram and movable rack maintain their relative positions, so large gears 28 do not rotate, and the ram moves downward with the rack. Typically, this is the part of the travel during which the tooling on the end of the ram has not yet engaged the workpiece, and a large amount of pressure is not yet required.

As the travel progresses, small gears 50 eventually begin to mesh with stationary racks 20. Further downward movement of the ram therefore requires that small gears 50 rotate, so large gears 28 must also rotate. Since the force applied by main air cylinder 58 is much greater than that applied by air cylinder 46, downward motion of rack 54 continues, and ram 40, which had been moving at the same velocity as movable rack 54, now begins moving downward relative to it, forcing piston rod 47 to begin to retract.

It will be appreciated that the ratio of the downward velocity of the rack to the downward velocity of the ram during this part of the travel is equal to unity plus the ratio of the radius of the large gears 28 to that of the small gears 50. This is also the ratio of the force applied by the ram to that applied by main air cylinder 58. Thus, while the ram has a relatively high velocity during the initial portion of the travel during which it is not engaged with the workpiece, it has a slower velocity and consequently a higher force during that part of the travel during which it can be expected to encounter the workpiece. This is accomplished despite the fact that the force is applied essentially by a single cylinder, and thus the motion is quite smooth and repeatable.

Although most of the force applied by the ram has its source in main cylinder 58, air cylinder 46 can also be employed to add to the downward force applied by the ram. This is accomplished by merely reversing the actuation pressure of cylinder 46, which is actuable in both directions, after stationary racks 20 are engaged. This urges the interior piston of cylinder 46 toward its relatively retracted position. Although this applies an upward force to the ram, it also applies a downward force to movable rack 54, and this downward force is multiplied by the gear mechanism. There is therefore a net increase in downward force on the ram when the actuation of cylinder 46 is reversed. Since the force applied by cylinder 46 is relatively small, its application does not interfere significantly with the advantageous smoothness and repeatability that is achieved through the employment of the teachings of the present invention.

Of course, if extra smoothness is desired, it is not necessary to reverse the actuation of air cylinder 46. An arrangement for this type of operation would be somewhat simpler in construction, and the construction could be simplified even further by the replacement of air cylinder 46 with a spring. However, it is thought that the air-cylinder version will be found to be more satisfactory in most applications than the spring version.

Actuation of air cylinder 46 to reverse the force applied by it can conveniently be accomplished by valving compressed air to it in accordance with the output of a pressure switch (not shown) in the main air cylinder. Such switches are typically included in hot-stamping machines to detect the back pressure that accompanies engagement of the workpiece, so little additional instrumentation is required. However, if an increase in repeatability is desired, a position sensor could be substituted to signal the point of initial engagement of small gears 50 with stationary racks 20. Reversal of the actuation of cylinder 46 would then occur at the point of initial engagement. Of course, other switching points would also be possible.

Once the pressure portion of the stroke has been completed, the pressure in main air cylinder 58 is relieved, permitting spring 78 to again raise the ram. During the first part of the upward stroke, small gears 50 still engage stationary racks 20, and the relative velocities of the ram and movable rack 54 are accordingly determined by the gear ratios alone; the direction of actuation of pneumatic cylinder 46 has no effect on the relative positions of movable rack 54 and the ram during this portion of the stroke. At this point at which smaller gears 50 become spaced from stationary racks 20, however, relative motion between movable rack 54 and the ram could occur if cylinder 46 were actuated so as to urge its internal piston in the downward direction. This would be undesirable because it would permit the spring to raise the ram without at the same time raising movable rack 54 and the piston internal to main air cylinder 58. Accordingly, it is necessary for the actuation of pneumatic cylinder 46 to be reversed before smaller gears 50 become disengaged from stationary racks 20. This would typically be effected in response to the same pressure switch as that by which the initial reversal was controlled. With the pneumatic cylinder 46 actuated to urge its internal piston toward the extended position, the spacing of the movable rack 54 and the ram is maintained when smaller gears become disengaged from stationary racks 20. Accordingly, the main air piston is raised along with the ram, and the press is returned to the position initially shown in FIG. 1.

It will be appreciated that presses that embody the teachings of the present invention achieve both the force advantages of two-stage operation and the smoothness and repeatability heretofore obtainable only in one-stage operation. These advantages are obtained in a structure that is simple and, due to the use of a single long-stroke main air cylinder, relatively inexpensive.

It will also be appreciated by those skilled in the art that the teachings of the present invention lend themselves to adaptation in a variety of alternatives to the mechanism illustrated by the preferred embodiment. For instance, it is clear that the number of gears used in the preferred embodiment is merely representative. A single large gear could be employed for engagement with both the movable rack and the stationary rack. Of course, this would only result in a doubling of force, whereas a large range of force ratios is possible with the arrangements similar to that illustrated by the preferred embodiment. In the preferred embodiment, the gear ratio shown is about 2:1 which results in tripling of force, and different radius ratios would result in still further force ratios.

In further variations, the gears may not all have to be mounted on the same gear shaft; any gear means can achieve the same result if all gears must rotate whenever one rotates. For instance, if a rather high force amplification is desired, three mutually meshing gears on separate axes could be used in place of the gears of the illustrated embodiment, which have a common axis.

Still further variations within the scope of the following claims will also be suggested to those skilled in the art by the foregoing description.

Having thus described the invention, we claim:

1. A stamping press with an augmented power stroke comprising:

a. a support having a guide portion;

b. a ram slidably seated in said guide portion of said support for movement between first and second positions, said ram having a head portion at one end thereof adapted for mounting tool means thereon, said head portion being spaced from a workpiece when said ram is in said first position thereof and being spaced adjacent the workpiece when said ram is in said second position thereof;

c. elongated movable rack means providing a rack surface thereon extending generally parallel to the axis of movement of said ram;

d. drive means operatively connected to said movable rack means for reciprocation of said movable rack means in the direction of movement of said ram;

e. elongated stationary rack means fixedly mounted on said support and providing a rack surface extending generally parallel to said movable rack surface;

f. gear means on the end of said ram opposite said head portion, said gear means meshing with said rack surface of said movable rack means, said gear means being spaced from said stationary rack surface in said first position of said ram, said gear means meshing with said stationary rack surface, when said movable rack means move to a predetermined engagement distance from said second position, to produce movement of said ram in the direction of movement of said movable rack means but at a speed lower than that of said movable rack means, thereby affording said movable rack means in a mechanical advantage while said ram is between said second position and the predetermined engagement distance from said second position; and g. means for maintaining said ram substantially in a predetermined position relative to said movable rack means while said stationary rack surface is spaced from said gear means but permitting relative movement while said stationary rack surface meshes with said gear means, said ram thereby moving with substantially the same velocity as that of said movable rack means while said stationary rack surface is spaced from said gear means but moving with a velocity whose ratio to that of said movable rack means is determined by said gear means when said stationary means meshes with said gear means.

2. The stamping press of claim 1 wherein said gear means include at least first and second gears, said first gear meshing with said stationary rack surface when said ram is less than the predetermined engagement distance from said second position, said first gear being spaced from said stationary rack means when said ram is more than said predetermined engagement distance from said second position, said second gear meshing with said movable rack and being mechanically linked to said first gear for travel of said first gear along said stationary rack means in the direction of movement of said movable rack means but at a speed lower than that of said movable rack means while said first gear of said gear means meshes with said stationary rack means.

3. The stamping press of claim 2 wherein said first gear has radius smaller than that of said second gear.

4. The stamping press of claim 2 wherein said gear means includes a gear shaft mounted for rotation about its axis on the end of said ram opposite said head portion, said gear shaft being disposed between said stationary and movable rack means, said first and second gears being coaxially mounted on said gear shaft for rotation with it.

5. The stamping press of claim 4 wherein said first gear has a smaller radius than said second gear.

6. The stamping press of claim 2 wherein said movable rack means provides a second rack surface parallel to said first-mentioned movable rack surface and extending parallel thereto on the side of said movable rack means opposite said first movable rack surface, said stamping press further including:

a. second elongated stationary rack means fixedly mounted to said support and providing a stationary rack surface extending generally parallel to said movable rack surfaces and spaced from said second movable rack surface on the side of said movable rack means opposite said first-mentioned stationary rack means; and b. second gear means on the end of said ram opposite said head portion, said second gear means meshing with said second movable rack surface, being spaced from said second stationary rack surface in said first position of said ram, and, when said ram moves to a predetermined engagement distance from said second position, meshing with said second stationary rack means to produce movement of said ram in the direction of movement of said movable rack means but at a speed lower than that of said movable rack means.

7. The stamping press of claim 6 wherein said second gear means includes at least first and second gears thereof, said first gear thereof meshing with said second stationary rack surface when said ram is less than said predetermined engagement distance from said second position, said first gear of said second gear means being spaced from said second stationary rack surface when said ram is more than said predetermined engagement distance from said second position, said second gear of said second gear means meshing with said second movable rack surface and being mechanically linked to said first gear of said second gear means for travel of said first gear of said second gear means along said second stationary rack means in the direction of movement of said movable rack means but at a speed lower than that of said movable rack means while said first gear of said second gear means meshes with said second stationary rack surface.

8. The stamping press of claim 7 wherein said second gear means includes a gear shaft thereof mounted for rotation about its axis on the end of said ram, said gear shaft of said second gear means being disposed between said second stationary rack means and said movable rack means, said first and second gears of said second gear means being coaxially mounted on said gear shaft of said second gear means for rotation with it.

9. The stamping press of claim 8 wherein each of said first and second gear means includes a third gear thereof mounted coaxially with said first and second gears thereof on said gear shaft thereof for rotation with said gear shaft, said third gear of each gear means having a diameter that is the same as that of said first gear of the same gear means and being mounted on the side of said second gear of said gear means opposite said first gear thereof, said stamping press further including third and fourth stationary rack means fixedly mounted on said support, each of said third and fourth stationary rack means providing a rack surface spaced from and extending generally parallel to said movable rack surfaces, said third and fourth stationary rack means being spaced from said third gears of said first and second gear means, respectively, when said ram is in its first position, said third gears of said first and second gear means meshing with said third and fourth stationary rack surfaces, respectively, when said ram moves to said predetermined engagement distance from said second position.

10. The stamping press of claim 1 wherein said drive means include a main fluid-operated piston-and-cylinder unit including a main cylinder fixedly mounted on said support and a main piston slidably received in said main cylinder for movement substantially parallel to the axis of movement of said ram between relatively extended and retracted positions, said main piston being operatively connected to said movable rack means for driving thereof, said main piston-and-cylinder unit being operable by application of pressurized fluid thereto to apply force to said movable rack means to drive it in the direction of said head portion of said ram.

11. The stamping press of claim 10 wherein said drive means include spring means biasing said ram toward said first position to return said ram to said first position upon removal of the force of said main piston-and-cylinder unit from said movable rack means.

12. The stamping press of claim 1 wherein said means for maintaining said ram substantially in a predetermined position relative to said movable rack means while said stationary rack means is spaced from said gear means include a fluid-operated piston-and-cylinder unit including a piston slidably mounted in said cylinder for movement substantially parallel to the axis of movement of said ram between extended and retracted positions, one of said piston and said cylinder being attached to said ram, the other of said piston and said cylinder being attached to said movable rack means, said piston-and-cylinder unit being operable by application of pressurized fluid thereto to bias said piston toward said extended position and thereby maintain said movable rack means and said ram in their predetermined relative position when said gear means is spaced from said stationary rack surface.

* * * * *